US007726649B2

(12) United States Patent
Domoto et al.

(10) Patent No.: US 7,726,649 B2
(45) Date of Patent: Jun. 1, 2010

(54) AIR DRAG COOLER FOR SHEET TRANSPORT APPARATUS

(75) Inventors: Gerald A. Domoto, Briarcliff Manor, NY (US); Elias Panides, Whitestone, NY (US); Nicholas Kladias, Fresh Meadows, NY (US)

(73) Assignee: Xerox Corporation, Norwalk, CT (US)

( * ) Notice: Subject to any disclaimer, the term of this patent is extended or adjusted under 35 U.S.C. 154(b) by 325 days.

(21) Appl. No.: 11/147,032

(22) Filed: Jun. 7, 2005

(65) Prior Publication Data

US 2006/0285874 A1 Dec. 21, 2006

(51) Int. Cl.
*B65H 29/24* (2006.01)

(52) U.S. Cl. ..... 271/195; 399/92

(58) Field of Classification Search ..... 271/195, 271/194, 92, 341, 405; 399/92, 341, 405
See application file for complete search history.

(56) References Cited

U.S. PATENT DOCUMENTS 3,918,706 A * 11/1975 Craft ..... 271/250
4,317,563 A * 3/1982 Zimmerman et al. ..... 271/211
4,418,905 A * 12/1983 Garavuso ..... 271/98
4,561,645 A * 12/1985 Pollich ..... 271/195
4,632,377 A 12/1986 Browse
4,693,014 A * 9/1987 Caflisch et al. ..... 34/464
4,702,468 A * 10/1987 Pollich ..... 271/195
4,811,547 A * 3/1989 Raats et al. ..... 53/284.4
5,066,984 A 11/1991 Coombs
5,357,327 A * 10/1994 Solano et al. ..... 399/406
5,557,387 A 9/1996 Hatano
5,623,720 A 4/1997 Howe et al.
5,687,964 A * 11/1997 Stephan et al. ..... 271/195
5,797,327 A * 8/1998 Gieser et al. ..... 101/483
5,915,304 A * 6/1999 Stiel ..... 101/416.1
6,173,136 B1 1/2001 Fuchiwaki et al.
6,314,268 B1 11/2001 Giunta et al.
6,435,088 B2 * 8/2002 Fujimoto ..... 101/232
6,505,030 B1 1/2003 Santiago et al.
6,564,473 B2 * 5/2003 Aydore ..... 34/504
6,585,259 B2 * 7/2003 Kerpe et al. ..... 271/195
6,603,938 B2 * 8/2003 Tsubakimoto ..... 399/92
6,654,573 B2 * 11/2003 Carlson et al. ..... 399/92
6,669,187 B1 * 12/2003 Clark ..... 271/98
6,782,228 B1 8/2004 Rasch et al.
6,823,151 B2 * 11/2004 Carlson et al. ..... 399/92
7,020,411 B2 * 3/2006 Awaya ..... 399/92
7,194,221 B2 * 3/2007 Kim et al. ..... 399/92
7,194,222 B2 * 3/2007 Murooka ..... 399/92
2003/0156871 A1 * 8/2003 Carlson et al. ..... 399/390
2004/0047644 A1 * 3/2004 Carlson et al. ..... 399/92

* cited by examiner

*Primary Examiner*—Patrick Mackey
*Assistant Examiner*—Michael C McCullough
(74) *Attorney, Agent, or Firm*—Maginot, Moore & Beck LLP

(57) ABSTRACT

In a sheet transport system for a reproduction machine, the transport system defining a transport channel through which the sheet travels in a transport direction, an improvement comprises one or more plenums associated with the transport channel, each plenum connectable to an air flow supply, and one or more openings between each plenum and the transport channel. At least one of the one or more openings is arranged to direct air flowing through the plenum into the transport channel in the transport direction.

17 Claims, 7 Drawing Sheets

AIR DRAG COOLER FOR SHEET TRANSPORT APPARATUS

TECHNICAL BACKGROUND

The present disclosure relates generally to electrostatic reproduction machines, and more particularly to an apparatus to assist in the transport of sheets through such machines.

In a typical toner image reproduction machine, for example an electrostatic printing process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrostatic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multi-pass architectures form each color separation with a single charge, image and develop, with separate transfer operations for each color.

In either case, the toner image ordinarily is transferred unfused onto a copy sheet of paper, which is then picked up by a transport mechanism (a pre-fuser transport) for delivery to a fuser assembly where the toner is heated and fused to make a finished copy. Conventional pre-fuser transport mechanisms typically use rotating belts stretched between a drive shaft and an idler shaft with perforations in the belts that allow vacuum pressure from a blower to be drawn through holes in a plate below the belts, and through the belts to the sheet. The vacuum pressure assists each sheet of paper that has an image on it via electrically charged toner particles, to be pulled off the photoreceptor and acquired on the pre-fuser transport, without disturbing the unfused image on the sheet, especially in the transfer zone. The sheet is then transported and delivered to the fuser module where the toner particles are heated and pressure-fused to the sheet.

Referring to FIG. 1, a typical electrostatic or electrophotographic printing machine is depicted. The machine employs a photoconductive belt that is preferably made from a photoconductive material coated on a grounding layer, which, in turn, is coated on an anti-curl backing layer. The photoconductive material is made from a transport layer coated on a generator layer. The transport layer transports positive charges from the generator layer. The belt moves in the direction of the arrow to advance successive portions of the photoconductive surface sequentially through the various processing stations disposed about the path of movement thereof. Initially, a portion of the photoconductive surfaces passes through a charging station A. At the charging station A, two corona generating devices charge photoconductive belt to a relatively high, substantially uniform potential.

Next, the charged portion of photoconductive belt is advanced through an imaging station B. At the imaging station B, a document handling unit H is positioned over a platen of the printing machine. The document handling unit H sequentially feeds documents from a stack of documents to be copied. After imaging, the original document is returned to a document tray by either of two paths. If a simplex copy is being made or if this is the first pass of a duplex copy, the original document is returned to the document tray via a simplex path. If this is the inversion pass of a duplex copy, then the original document is returned to the document tray through the duplex path.

Imaging of the document is typically achieved by two Xenon flash lamps which illuminate the document on the platen. Light rays reflected from the document are transmitted through a lens that focuses light images of the original document onto the charged portion of the photoconductive surface of belt to selectively dissipate the charge thereon. This event records an electrostatic latent image on photoconductive belt which corresponds to the informational areas contained within the original document. Thereafter, the photoconductive belt advances the electrostatic latent image recorded thereon to the development station C.

At the development station C, a magnetic brush developer unit delivers developer to developer rolls. The photoconductor belt is partially wrapped about the rolls to form extended development zones. Thus, the developer rolls advance developer material into contact with the electrostatic latent image. The latent image attracts toner particles from the carrier granules of the developer material to form a toner powder image on the photoconductive surface of belt. The belt then advances the toner powder image to a transfer station D.

At the transfer station D, a copy sheet is moved into contact with the toner powder image. First, the photoconductive belt is exposed to a pre-transfer light from a lamp (not shown) to reduce the attraction between the belt and the toner powder image. Next, a corona generating device charges the copy sheet to the proper magnitude and polarity so that the copy sheet is tacked to the photoconductive belt and the toner powder image attracted from the photoconductive belt to the copy sheet. After transfer, the corona generator charges the copy sheet to the opposite polarity to detach the copy sheet from the belt. A conveyer typically advances the copy sheet to a fusing station E.

The fusing station E includes a fuser assembly which permanently affixes the transferred toner powder image to the copy sheet. Preferably, the fuser assembly includes a heated fuser roller and a pressure roller with the powder image on the copy sheet contacting fuser roller. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets may be fed through a decurler 55. The decurler 55 bends the copy sheet in such a way that the sheet curl produced during the fusing operation is substantially reduced. The decurler may be configured as disclosed in U.S. Pat. No. 6,314,268, issued to the assignee of the present invention on Nov. 6, 2001. The disclosure of this application, and particularly the description of the reproduction machine and the interface between the fusing station and the decurler, is incorporated herein by reference.

Forwarding rollers 62 then advance the sheet along a transport chute 60 to a duplex solenoid gate 65. This gate guides the sheet to a finishing station F or to a duplex tray 70. The duplex tray provides an intermediate storage for those sheets that have been printed on one side and on which an image will be subsequently printed on the second, opposed side thereof—i.e., the sheets being duplexed. In order to complete duplex copying, the simplex sheets in tray 70 are fed back to the transfer station D for transfer of the toner powder image to the opposed sides of the copy sheets. The duplex sheet is then fed through the same path as the simplex sheet to be advanced to the finishing station F.

Copy sheets are fed to the transfer station D from a high speed feeder tray I or from secondary trays 72. In many machines, a vacuum feed belt feeds successive uppermost sheets from the trays to the transfer station D.

One problem with electrostatic reproduction machines of the type just described is that the copy sheets are often difficult to extract from the fuser rolls. Many machines incorporate a stripper apparatus that separates the leading edge of a sheet from a heated fuser roll. One example of an apparatus of this type is disclosed in U.S. Pat. No. 6,782,228, issued to the assignee of the present invention on Aug. 24, 2004.

Another problem with electrostatic reproduction machines is that the copy sheets leaving the fusing station E are at a high enough temperature to cause blocking—i.e., successive sheets stick together. Moreover, in the duplexing mode, the high sheet temperature often causes defects in the image transferred in the duplex pass through the machine.

One solution to this problem has been to lengthen the transport path of the sheet as it exits the fusing station. This approach inherently increases the space required between the fusing station E and the solenoid gate 65. In addition, the lengthened transport path usually requires the use of nip rollers, such as the rollers 62 shown in FIG. 1, which can mar the transferred image. Another approach to solving the high temperature problem has been to direct machine air flow across the sheet as it exits the fusing station. In some cases, this air flow may be disruptive to the smooth transport of the sheet to the subsequent stations. Moreover, the amount of air flow required to adequately cool sheets leaving the fusing station at high page-per-minute rates typically requires an air flow system that is size or cost prohibitive.

There is a need for a transport apparatus that addresses the high temperature problem associated with sheets discharged from a typical fusing station. This need is particularly acute for high volume reproduction machines and for machines with duplex capabilities.

SUMMARY

This need is addressed by the introduction of an air drag cooler downstream of the fusing station. In a preferred embodiment, the air drag cooler is positioned between the fuser rolls and either a decurler apparatus, the solenoid gate for a machine having a duplex mode, or the finishing station. The air drag cooler includes one or more plenums mounted to the post-fuser transport chute. The plenums direct air at an angle relative to the transport direction of travel of the copy sheet through the transport chute so that the air flow assists in the movement of the sheet therethrough.

In a sheet transport system for a reproduction machine, the transport system having a transport chute defining a transport channel through which the sheet travels in a transport direction, an improvement comprises one or more plenums associated with the transport chute, each plenum connectable to an air flow supply, and one or more openings between each plenum and the transport channel. At least one of the one or more openings is arranged to direct air flowing through the plenum into the transport channel in the transport direction. In certain embodiments, the one or more openings comprises a slot extending across the transport chute transverse to the transport direction. The slot is configured to direct air flowing through the plenum at a non-parallel and non-perpendicular angle relative to the transport direction.

The improvement may further comprise one or more discharge outlets defined in the transport chute. The discharge outlets may include the inlet and the outlet of the transport chute as well as one or more discharge outlets arranged between the inlet and the outlet of the transport chute. In certain embodiments, each of the one or more plenums has at least one discharge outlet positioned downstream thereof along the transport direction.

For a sheet transport system in a reproduction machine, the transport system having a transport chute defining a transport channel through which the sheet travels in a transport direction, a method comprises the step of directing a flow of air along the transport channel in the transport direction from one or more locations between the inlet and the outlet of the transport chute. The method may further comprise the step of exhausting air flowing through the transport chute at one or more locations between the inlet and the outlet of the transport chute. In certain embodiments, air is directed into the transport channel at two or more locations along the transport chute, and air is exhausted from the transport chute at a location between each of the locations at which air is directed into the transport channel.

For a sheet transport system in a reproduction machine between a fusing station to a downstream station of the machine, the transport system having a transport chute defining a transport channel through which the sheet travels in a transport direction, another method comprises the steps of directing a flow of air into the transport channel to cool a sheet as it travels in the transport direction and exhausting relatively warmer air from the transport chute. In certain embodiments, the flow of air is directed into the transport channel at a plurality of locations between the inlet and the outlet of the transport chute. In some embodiments, the relatively warmer air is exhausted from the transport channel at a plurality of locations between the inlet and the outlet of the transport chute.

It is one object to provide a transport system and method to overcome difficulties with prior techniques for transporting sheet material through a reproduction or printing machine. It is a further object to provide such a transport system that avoids the difficulties encountered with sheets passing from a high temperature fusing station to a downstream station of the machine.

One benefit of disclosed system and method is that it provides means to reduce the temperature of the sheet material as it is conveyed from a high temperature component, such as a fusing station, to a downstream station of the machine. A further benefit is that the system and method can be readily integrated into a high speed reproduction or printing machine. Other objects and benefits will be discerned from the following written description and accompanying figures.

DETAILED DESCRIPTION OF THE EMBODIMENTS

Figure 1:
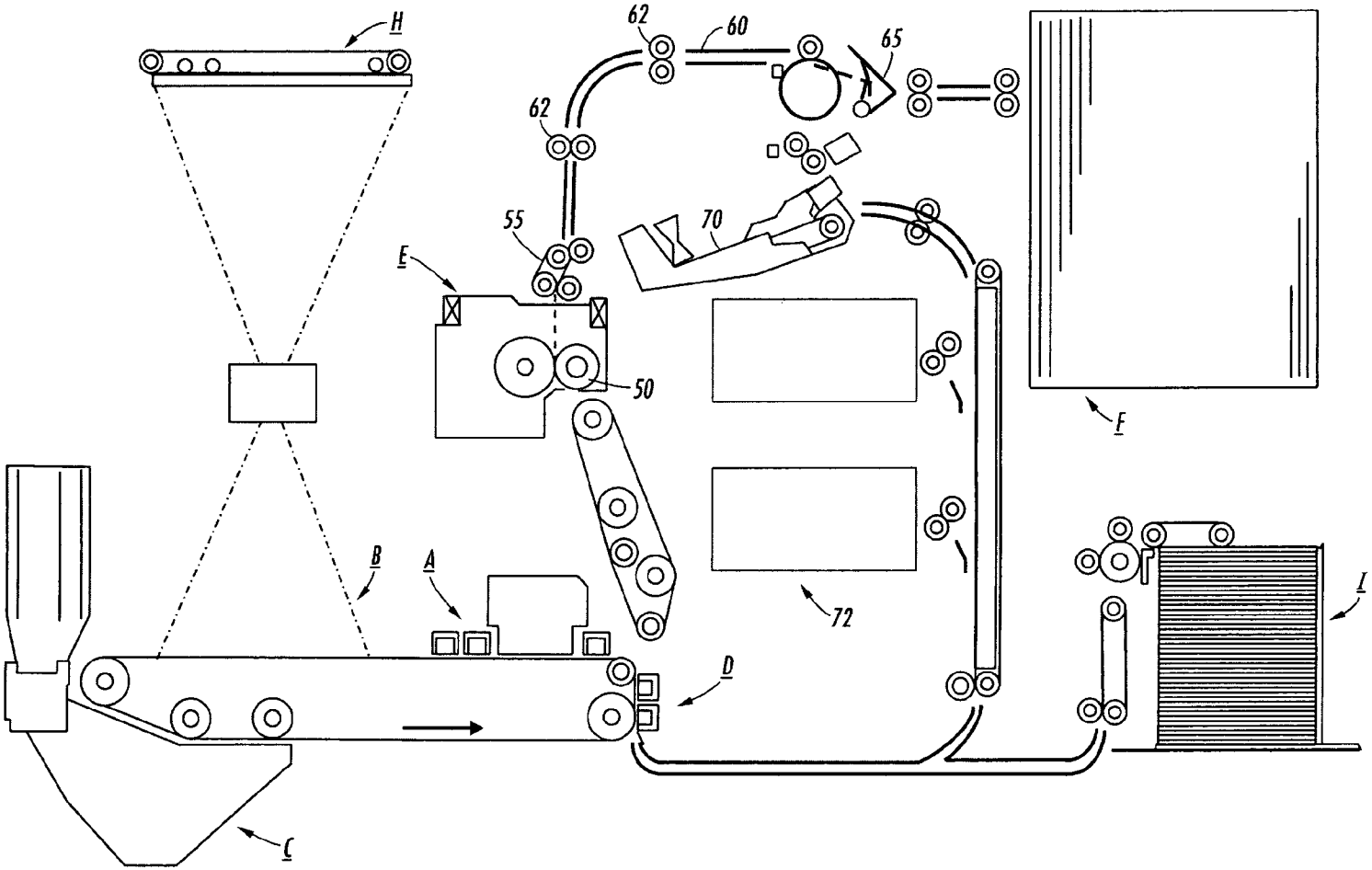
FIG. 1 (PRIOR ART)
FIG. 1 is a schematic representation of one type of electrostatic reproduction printer.

The present disclosure relates to improvements for a reproduction machine, such as an electrostatic reproduction printer depicted schematically in FIG. 1. In particular, the improvement is directed to an apparatus that is integrated into a transport chute receiving a copy sheet from the fusing station E for conveyance to a downstream station. In a preferred embodiment, the apparatus is disposed between the fusing station E and the decurler 55. Alternatively, if no decurler is present, the apparatus may be disposed between the fusing station E and solenoid gate 65, if the machine has a duplex mode, or between the fusing station and the finishing station F.

Figure 2:
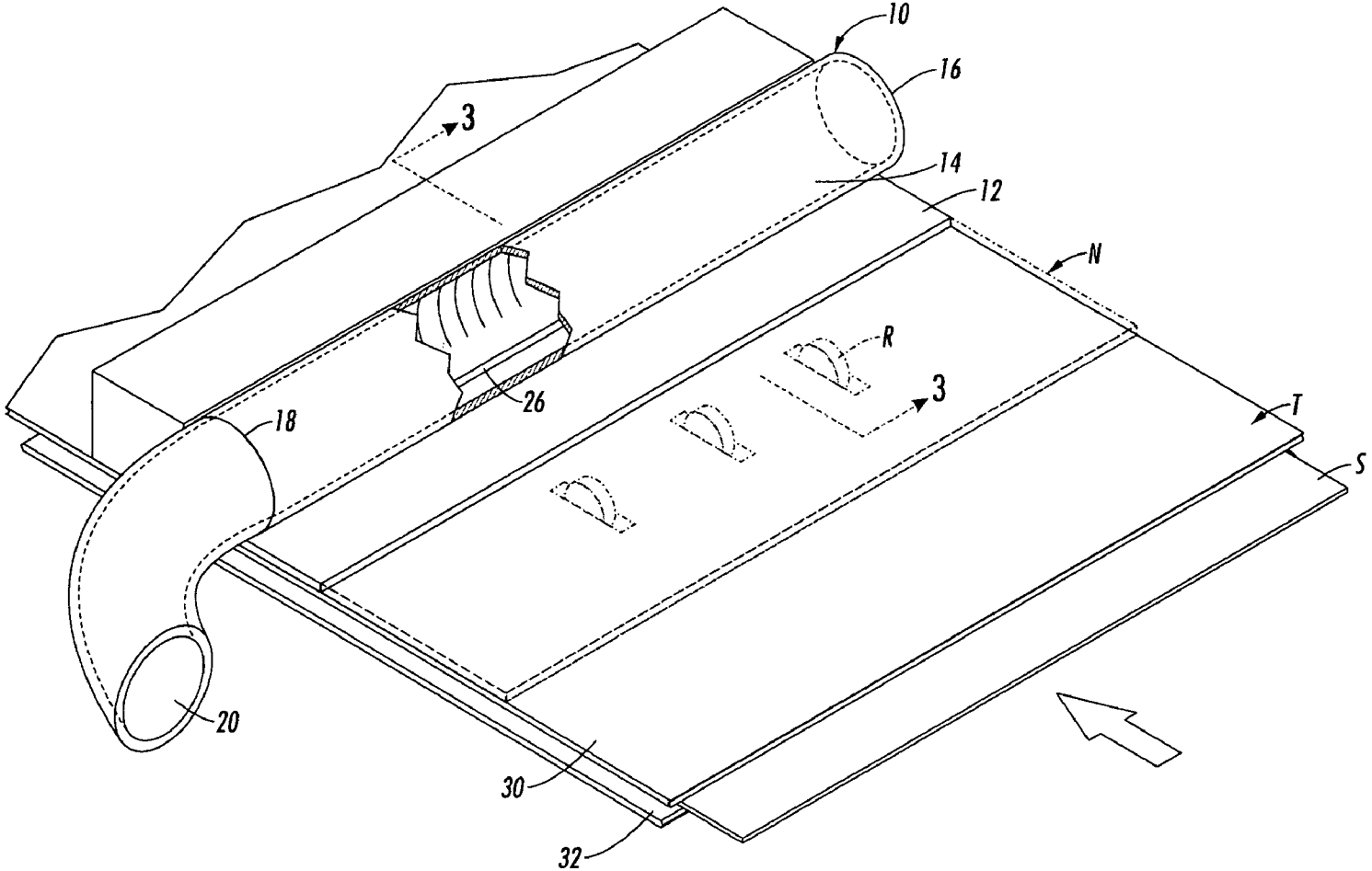
FIG. 2 is an enlarged perspective view of a portion of a transport chute with the air drag cooler of one embodiment mounted thereon.
Figure 3:
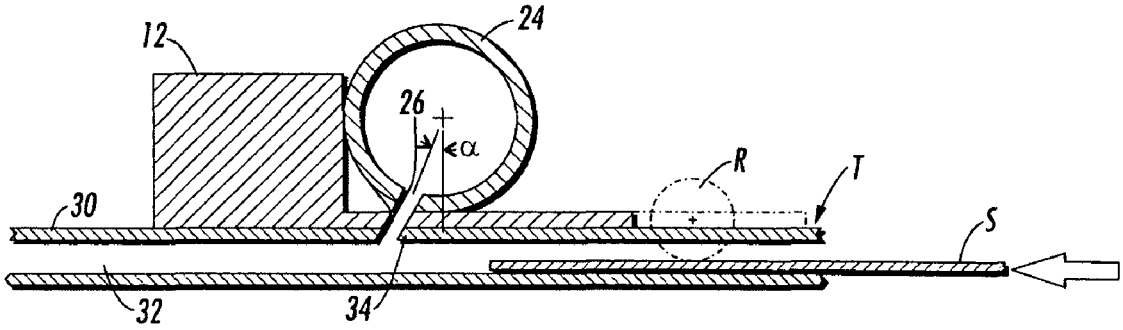
FIG. 3 is an enlarged side cross-sectional view of the air drag cooler shown in FIG. 2.

The improvement to the reproduction machine contemplates an air drag cooler apparatus 10 that is integrated into a transport chute, such as the chute 60 shown in FIG. 1. The apparatus 10 includes a mounting base 12 that is mounted to a wall 30 of the transport chute T, as illustrated in FIGS. 2-3. The base 12 may be attached to the wall 30 in a conventional manner, such as by screws or bolts (not shown).

The mounting base 12 supports a plenum 14 that is arranged generally transversely across the transport chute T or cross-wise relative to the transport direction of the sheet S through the chute. The plenum includes a closed or capped end 16 and an opposite inlet end 18. The inlet end is connected to an inlet manifold 20 through which a flow of air is supplied. The inlet manifold 20 is coupled to an air supply, which is preferably in the form of a fan or similar air-moving device that is arranged to draw ambient air from outside the reproduction machine. In certain embodiments, the inlet manifold 20 may be connected to the air supply for an on-board vacuum belt sheet corrugation feeder, such as the bottom sheet separator and feeder disclosed in U.S. Pat. No. 4,632,377, the disclosure of which is incorporated herein by reference. However, it is preferred that the air supply to the inlet manifold be at room temperature to maximize the heat transfer attributes of the air drag cooler (as described in more detail herein). Thus, in the preferred embodiment, the inlet manifold 20 is connected to a fan mounted on an outside wall of the reproduction machine (not shown).

The plenum 14 is formed by a plenum wall 24 that may be cylindrical, as depicted in FIG. 3, or rectangular. The plenum wall defines a slot 26 that is aligned toward the transport chute wall 30. The chute wall itself defines a mating slot 34 that is preferably co-extensive with the slot 26 in the plenum. In the preferred embodiment, the slots 26, 34 extend across substantially the entire width or transverse dimension of the chute T so that air exiting the slots impinges on the entire width of the sheet S passing through the transport channel 32.

As seen in FIG. 3, the slots 26, 34 are aligned at a non-perpendicular and non-parallel angle $\alpha$ relative to a centerline passing between the plenum 14 and the chute T. The slots are also arranged at a non-parallel and non-perpendicular angle relative to the transport direction through the chute. This angle of the slots causes air forced through the plenum and slot to contact the sheet S with a vector component along the direction of travel of the sheet through the channel 32. Thus, air provided to the plenum is directed toward the outlet 37 (FIG. 4) of the transport chute T to, in essence, drag the sheet along the channel 32. In a specific embodiment, the angle $\alpha$ is about 30° for a transport channel 32 height of about 2.0 mm. In other terms, the slot is at an angle of 60° relative to the transport direction through the chute. This angle may be modified as a function of the sheet S being transported through the channel and as a function of the channel height. For instance, a thicker and heavier sheet S may require a greater angle $\alpha$ to increase the air drag on the sheet and to therefor increase the transport "force" exerted on the sheet by the air flow.

As shown in FIGS. 2-3, the air drag cooler 10 may be preceded by a roller assembly N, shown in phantom lines, that incorporates a series of rollers R across the width of the transport chute T. The rollers help convey the sheet S into the air drag cooler 10. Most preferably, the roller assembly N is only present at the beginning of the transport chute T, such as immediately adjacent the fusing station E (FIG. 1). The rollers R grab the sheet as it exits the station E and aligns the sheet within the transport channel 32. The air drag cooler 10 may be situated immediately adjacent the roller assembly N so that the sheet is still in contact with the rollers R as the leading edge of the sheet traverses the slots 26, 34. With this orientation, any counter air flow (i.e., air flow back toward the fusing station) will not inhibit the transport of the sheet along the chute T. It is contemplated that each successive air drag cooler 10 along the downstream extent of the transport chute T will not include a roller assembly N, since the sheet will be adequately conveyed by the air flow alone.

Figure 4:
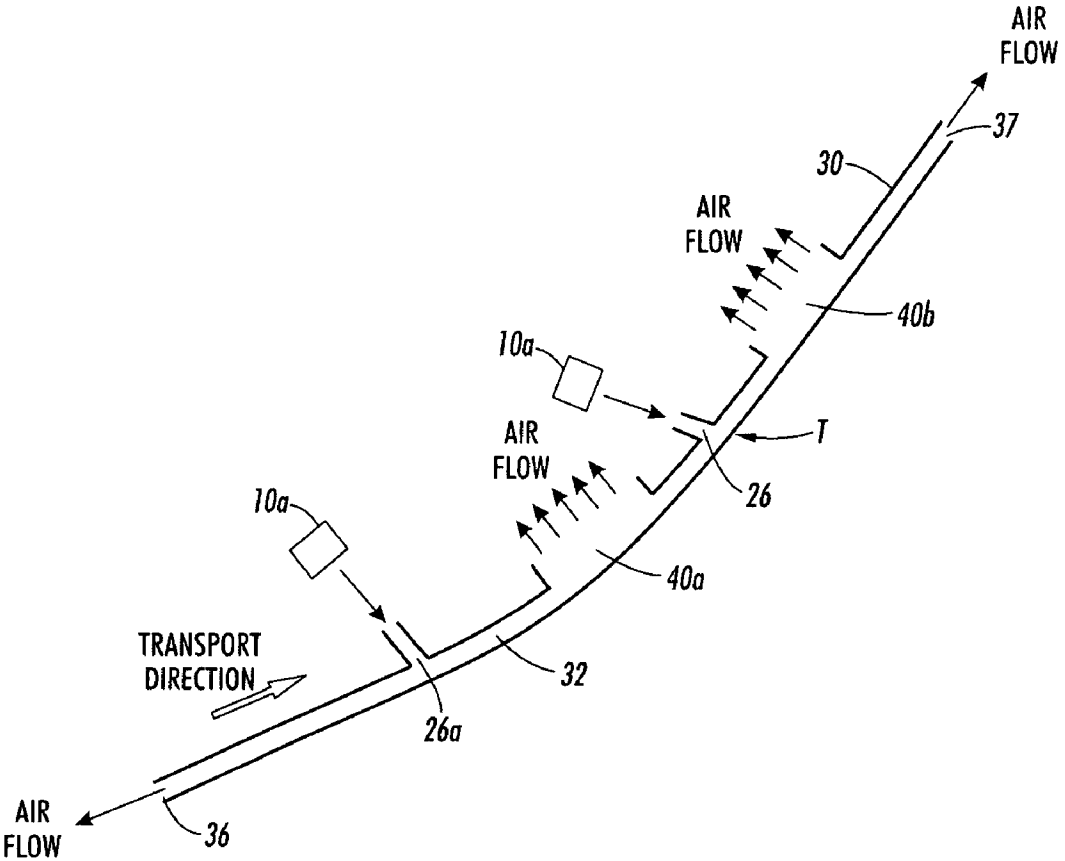
FIG. 4 is a schematic representation of a transport chute at the discharge end of a fusing station showing the position of components of the air drag cooler of one embodiment.

One arrangement utilizing the air drag cooler 10 is depicted schematically in FIG. 4. The transport chute T has an inlet 36 that may be integrated into the post-fuser transport section of a reproduction machine, as described above. The chute outlet 37 may feed the sheet material to a decurler apparatus 55 or to some other station of the machine. While the chute T shown in FIG. 4 is curved, the configuration of the transport chute will of course be dictated by the particular reproduction or printing machine.

In the illustrated embodiment, two air drag coolers 10*a*, 10*b* are provided with corresponding slots 26*a*, 26*b* intersecting the transport channel 32. The air drag coolers are preferably fed through a common manifold, such as the manifold 20, that is connected to a common air flow source. In certain embodiments, the air supplied through the air drag coolers may exit only at the inlet 36 and outlet 37. The angled orientation of the slots 26*a*, 26*b* will produce a greater air flow at the outlet 37 of the transport channel T than at the inlet 36, resulting in a net drag force in the transport direction.

This arrangement may be acceptable for short transport chutes T where only a single air drag cooler is utilized. However, for longer transport chutes, such as the chute T shown in FIG. 4, mid-channel exhaust outlets 40*a*, 40*b* are preferred. As illustrated, each exhaust outlet 40*a*, 40*b* is downstream of a corresponding air drag cooler 10*a*, 10*b*. The exhaust outlets are preferably closer to the next downstream air drag cooler (if one is present)—i.e., the exhaust outlet 40*a* is closer to the air drag cooler 10*b* than to the air drag cooler 10*a*.

In the preferred embodiment, the exhaust outlets 40*a*, 40*b* may comprise a single opening in the chute wall 30 of the transport chute T. The openings are arranged so that the air flow exits directly into the interior of the reproduction machine or may be vented in an appropriate manner. In a preferred embodiment, the exhaust outlets 40*a*, 40*b* comprise a plurality of apertures in the chute wall 30. The size and number or apertures may be calibrated to achieve a specific flow area for the exhaust outlets 40*a*, 40*b*. In one embodiment, the flow area for the exhaust outlets is related to the flow area of the corresponding slots 26*a*, 26*b*. In one specific embodiment, the slots 26*a*, 26*b* each have a dimension of about 1.0 mm, or approximately ½ of the height of the transport channel 32. In this specific embodiment, the exhaust outlets 40*a*, 40*b* are in the form of slots, similar to the slots 26*a*, 26*b*, with a dimension of about 2.0 mm, or approximately equal to the height of the transport channel. Three or more circular apertures may also be provided with an equivalent flow area to the 2.0 mm slot in the specific embodiment.

The air flow through the air drag coolers 10*a*, 10*b* into the transport channel 32 helps convey the sheet along the transport chute T. In addition, the air flow helps cool the sheet as it is conveyed. The addition of the intermediate exhaust outlets 40*a*, 40*b* thus facilitates the heat transfer from the sheet S to the flowing air and eventually out of the transport chute.

Figure 5:
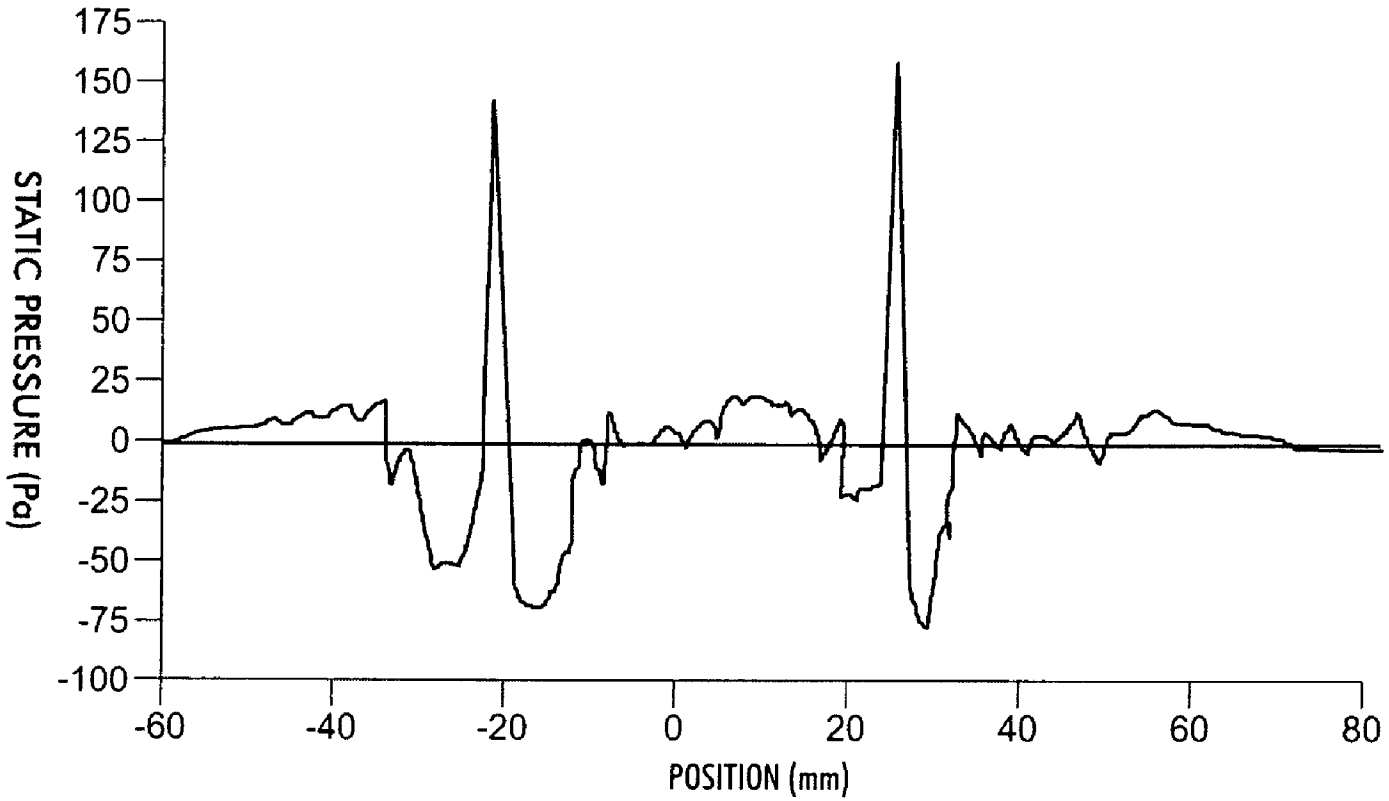
FIG. 5 is a graph of the static pressure measured at positions along the length of the transport chute shown in the schematic of FIG. 4 for a particular air inlet pressure and flow rate.
Figure 6:
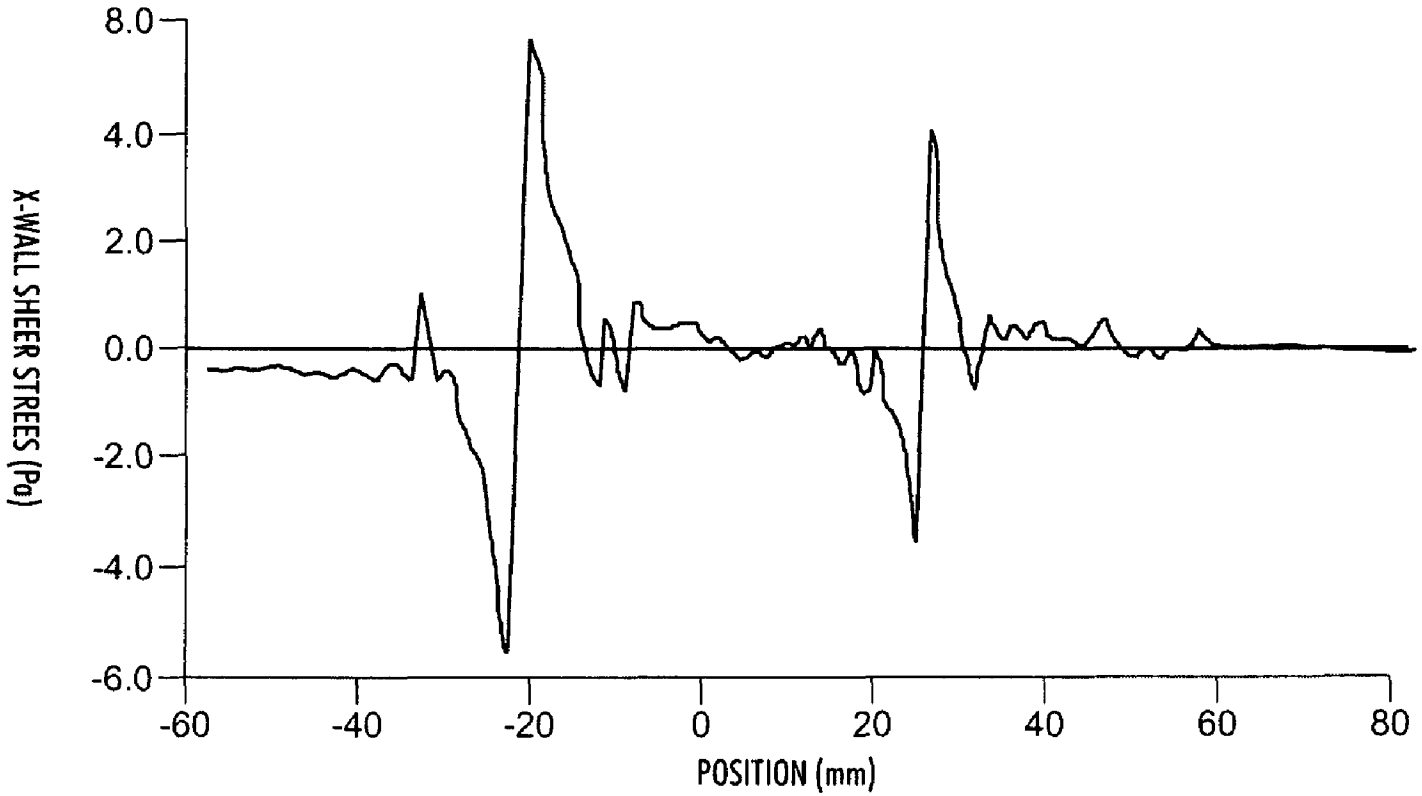
FIG. 6 is a graph of the shear or transport force measured at positions along the length of the transport chute shown in the schematic of FIG. 4 for a particular air inlet pressure and flow rate.
Figure 7:
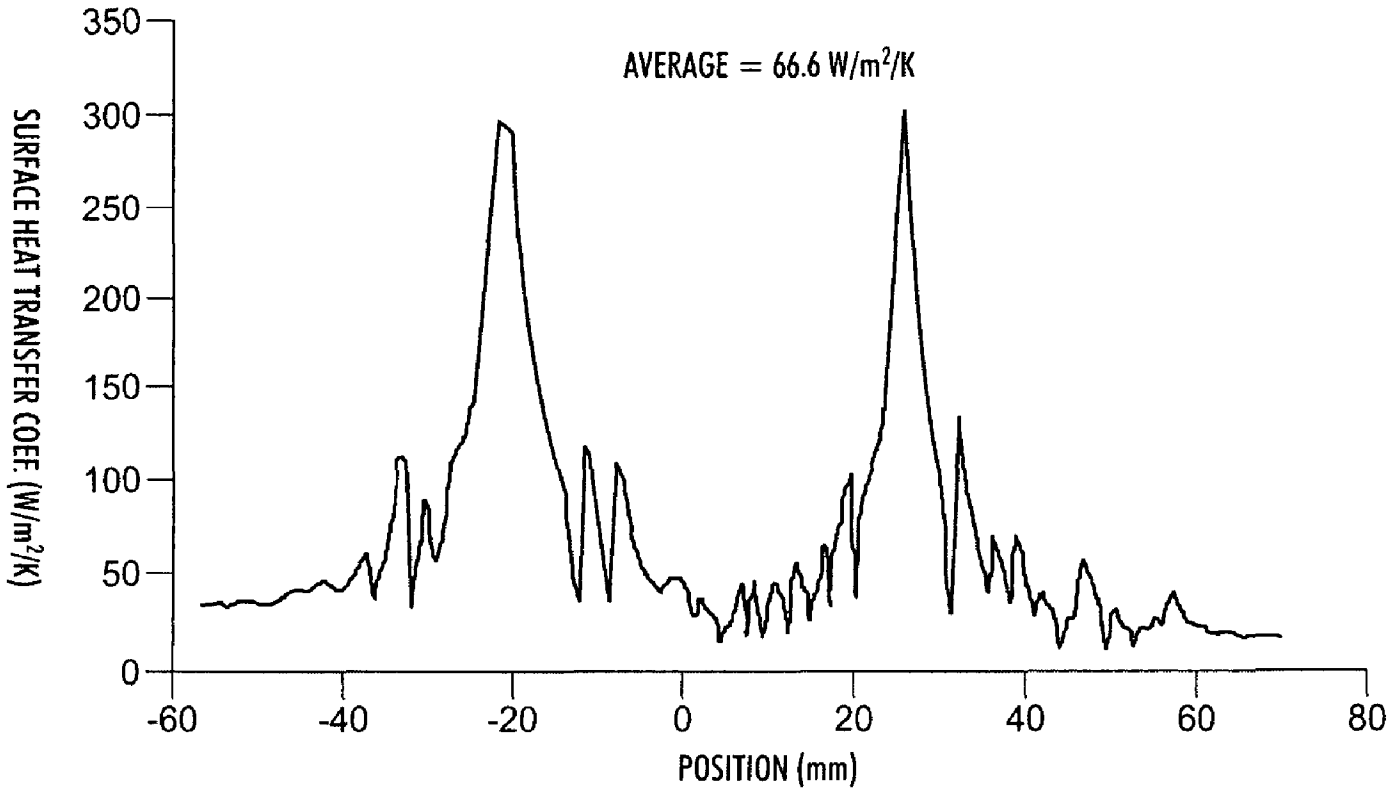
FIG. 7 is a graph of the heat transfer coefficient measured at positions along the length of the transport chute shown in the schematic of FIG. 4 for a particular air inlet pressure and flow rate.

The physical impact of the air drag coolers within the transport channel 32 is depicted in the graphs of FIGS. 5-7. These graphs pertain to the arrangement shown in FIG. 4, in which the transport chute T has a length from inlet 36 to outlet 37 of about 317.5 mm, and a uniform height along that length of about 2.0 mm. Air is introduced into the plenums 14 (FIGS. 2-3) of each of the two air drag coolers 10*a*, 10*b* at about 20 cfm, for a total air flow into the chute of about 40 cfm. Fluid dynamics models of this transport chute and air drag cooler combination suggest that the air flow exits the transport chute T at about 9.5 cfm at the inlet 36, 4.3 cfm at the outlet 37, 19.0 cfm at the first exhaust outlet 40*a* and 7.2 cfm at the second exhaust outlet 40*b*.

These inlet and exhaust flow rates produce a static pressure profile as shown in FIG. 5. The zero position (0.0 mm on the graph) corresponds to the mid-point along the length of the chute T, or generally in the middle of the exhaust outlet 40*a*. As the graph shows, the static pressure spikes at the two air drag cooler slots 26*a*, 26*b*. The negative pressure immediately adjacent each slot helps draw the sheet along the transport channel 32.

As explained above, the air flow through the channel produces drag that pulls the sheet S along the channel 32. A measure of this drag effect is the shear stress along the channel, as reflected in the graph of FIG. 6. Like the static pressure, the shear stress peaks (both positive and negative) adjacent each air drag cooler slot. While the dynamic analysis suggests negative shear at certain locations along the channel, the net shear is positive, which yields a net force in the transport direction. The greatest negative shear is from the inlet 36 to the first air drag cooler 10*a* (since air flow exits the inlet 36). The inclusion of the roller assembly N (FIG. 2) at inlet is sufficient to overcome this counter-force and ensure that the sheet is conveyed into the region of the transport channel downstream of the first air drag cooler. From the first air drag cooler 10*a* onward, the negative shear perturbations are overcome by the positive shear effect on the sheet, resulting in a net positive force in the transport direction.

In addition to the transport effect just described, the air drag coolers also convey heat from the sheet to help cool the sheet as it travels along the transport chute T. This heat transfer effect is reflected in the graph of FIG. 7. Again, as expected, peaks in heat transfer coefficient occur at each air drag cooler slot 26*a*, 26*b*. The positive coefficient along the entire length of the chute T means that the air flow exerts a cooling effect on the sheet along its entire journey through the transport chute. The total heat transfer effect of the air drag coolers is represented by the integral of the curve in FIG. 7. In the specific example, the two air drag coolers 10*a*, 10*b* can reduce the sheet temperature from about 150° C. as the sheet exits a typical fuser roll, to about 50° C., which is sufficiently low to avoid the blocking and image defect problems that often accompany high speed reproduction machines when the sheets discharged from the fusing station are too hot when entering a downstream station.

In the illustrated embodiment, the air drag coolers 10*a*, 10*b* are disposed on one side of the transport chute T. In some embodiments, it may be preferable to provide air drag coolers on opposite sides of the chute, either staggered relative to each other or directly opposite each other. In the latter case, the air flows exiting the opposing air drag cooler slots may tend to hold the sheet in the middle of the transport channel between the two air flows.

In other alternative embodiments, an exhaust outlet may be positioned immediately adjacent each air drag cooler slot. With this embodiment, a greater number of air drag coolers 10 and exhaust outlets 40 may be necessary to provide sufficient transport force and/or heat transfer capability. Moreover, with this embodiment, the slot dimensions may be reduced, as well as the air flow rate at each air drag cooler.

It should be appreciated that several parameters of the air drag cooler 10 may be varied depending upon the particular reproduction or printer machine, the material and properties of the sheet being processed by the machine and the location of the air drag cooler(s) within the machine. For example, the amount of air flow necessary to cool a sheet S will typically vary as a function of the sheet material and thickness. In addition, the temperature of the sheet as it is discharged from the fusing station and the desired cooled temperature of the sheet will dictate air drag cooler parameters, such as air flow, cooler slot dimensions, number of air drag coolers and location of the exhaust outlets, to name but a few relevant parameters. The available transport path distance between the fusing station and the next pertinent station of the machine also plays a part in the form and operation of the air drag cooler. While uniform air flow rates are contemplated for the two coolers of the specific example of FIG. 4, other applications may accommodate or even benefit from different air flow rates along the length of the transport path.

In the illustrated embodiments, the air drag slots 26, 34 have been described as generally rectangular slots spanning substantially the entire width of the transport chute. Other slot configurations are contemplated, such as a series of discrete slots spaced along the chute width. Since it is contemplated that the air drag coolers will direct the air flow so that a significant flow vector component is parallel to the transport direction, a rectangular shape may be preferred.

The illustrated embodiments also depict the air drag cooler slots as having a fixed dimension. However, it is contemplated that the slots may be provided with variable geometry, or more specifically variable flow area. With this modification, individual air drag coolers may be controlled to adjust its operational parameters as a function of the sheet passing through the machine. For instance, certain reproduction machines permit user input of the sheet dimensions or properties, while other machines include sensors to determine certain sheet properties as the sheet is fed into the machine. In these cases, that sheet property information may be used to adjust the operation of the air drag cooler(s).

One adjustment can be to the air flow rate provided to the air drag cooler(s). This adjustment may be accomplished by controlling the speed of the air flow generator, or fan. Another adjustment may be accomplished by a baffle (not shown) positioned within the manifold 20 through which air is supplied to the plenum 14 of each air drag cooler. Alternatively, the baffle may be disposed between the manifold and each plenum. The baffle may be adjusted to decrease the air flow into the plenum(s). Air flow rate may also be adjusted at the air drag cooler slot(s) 26. For instance, a shutter or baffle plate may be slidably mounted within the plenum 14 over the slot 26. Shifting the position of the shutter plate will change the flow area through the slot 26. A baffle arrangement similar to that disclosed in U.S. Pat. No. 6,505,030, which issued to the present assignee on Jan. 7, 2003, the disclosure of which is incorporated herein by reference, especially the disclosure related to FIGS. 3-4 of this patent.

In the described embodiments, the air drag cooler is implemented at post-fuser locations within a reproduction or printer machine. The air drag cooler(s) 10 may also be implemented at other stations of the machine, to cool the sheet material passing through the machine and/or to assist in propelling the sheet along the transport path. Thus, in certain applications, the air drag cooler may be used to replace one or more rollers to direct the sheet from one station to another.

It will be appreciated that the use of the term "reproduction machine" in the context of the present description is intended to be illustrative of any apparatus which performs a print outputting function for any purpose. Thus, the term "reproduction machine" may encompass a digital copier, bookmaking machine, facsimile machine, multi-function machine, and the like.

Likewise, with respect to the components of reproduction machine, other components, locations or stations within the machine are contemplated. For instance, while a fuser station has been described, the features and functions of the air drag cooler described herein may be used after any station in which the temperature of the sheet material is increased and/or in which an assist to the sheet transport is desired.

It will also be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet transport system for a reproduction machine, comprising:

a transport chute having an inlet through with a sheet enters the transport chute and an outlet from which the sheet exits the transport chute after traveling though the transport chute in a transport direction, the transport chute being substantially enclosed about the sheet traveling therethrough between the inlet and the outlet;

a plenum associated with the transport chute, the plenum connectable to an air flow supply; and an opening between the plenum and the substantially enclosed transport chute to direct air flowing through said plenum into the transport chute in the transport direction, said opening being a slot extending across the transport chute transverse to the transport direction and being disposed between the inlet and the outlet of the transport chute, wherein said transport chute and said opening are sized to achieve air flow into the transport chute sufficient to produce a net air drag force in the transport direction from the inlet to the outlet to transport the sheet through said transport chute by said air flow.

2. The sheet transport system of claim 1, wherein said slot extends substantially across the entire width of the transport chute transverse to the transport direction.

3. The sheet transport system of claim 2, wherein:

the transport chute has a height through which the sheet is transported; and said slot has a width that is approximately equal to one-half the height of the transport chute.

4. The sheet transport system of claim 1, wherein the slot directs air flowing though said plenum into the transport chute at a non-parallel and non-perpendicular angle relative to the transport direction.

5. The sheet transport system of claim 4, wherein said angle is about 60 degrees.

6. The sheet transport system of claim 1, further comprising a fan connected to the plenum to provide air flow therethrough.

7. The sheet transport system of claim 1, further comprising a discharge outlet being defined in the transport chute.

8. The sheet transport system of claim 7, wherein the discharge outlet is in fluid communication with the inlet and the outlet of the transport chute.

9. The sheet transport system of claim 7, wherein the discharge outlet is arranged between the inlet and the outlet of the transport chute.

10. The sheet transport system of claim 7, wherein the discharge outlet is positioned downstream of the plenum along the transport direction.

11. The sheet transport system of claim 7, comprising:

another plenum associated with the transport chute and connectable to an air flow supply; and the discharge outlet is positioned between the plenums.

12. A sheet transport system for a reproduction machine comprising:

a transport chute having an inlet through which a sheet enters the transport chute and an outlet from which the sheet exits the transport chute after traveling through the transport chute in a transport direction, the transport chute being substantially enclosed about the sheet traveling therethrough between the inlet and the outlet;

a first plenum associated with the transport chute, the first plenum connectable to an air flow supply;

a second plenum associated with the transport chute, the second plenum connectable to an air flow supply;

an opening between the first plenum and the substantially enclosed transport chute to direct air flow through said first plenum into the transport chute in the transport direction, said opening disposed between the inlet and the outlet of the transport chute, said transport chute and said opening are sized to achieve air flow into the transport chute sufficient to produce a net air drag force in the transport direction from the inlet to the outlet to transport the sheet through said transport chute by said air flow; and a discharge outlet defined in the transport chute, the discharge outlet being positioned downstream of the first plenum and upstream of the second plenum, downstream and upstream being identified with reference to the transport direction, the discharge outlet being closer to the second plenum than to the first plenum.

13. A sheet transport system for a reproduction machine comprising:

a transport chute having an inlet through which a sheet enter the transport chute and an outlet from which the sheet exits the transport chute after traveling through the transport chute in a transport direction, the transport chute being substantially enclosed about the sheet traveling therethrough between the inlet and the outlet;

a first plenum associated with the transport chute, the first plenum connectable to an air flow supply;

a second plenum associated with the transport chute, the second plenum connectable to an air flow supply, each plenum being disposed on the same side of the transport chute;

an opening between the first plenum and the substantially enclosed transport chute to direct air flow through said first plenum into the transport chute in the transport direction, said opening disposed between the inlet and the outlet of the transport chute, said transport chute and said opening are sized to achieve air flow into the transport chute sufficient to produce a net air drag force in the transport direction from the inlet to the outlet to transport the sheet through said transport chute by said air flow; and a discharge outlet defined in the transport chute, the discharge outlet being positioned between the plenums.

14. A sheet transport system for a reproduction machine, comprising:

a transport chute having an inlet through which a sheet enter the transport chute and an outlet from which the sheet exits the transport chute after traveling through the transport chute in a transport direction, the transport chute being substantially enclosed about the sheet traveling therethrough between the inlet and the outlet;

a plenum associated with the transport chute, the plenum connectable to an air flow supply;

an opening between the plenum and the substantially enclosed transport chute to direct air flowing through said plenum into the transport chute in the transport direction, said opening disposed between the inlet and the outlet of the transport chute, said transport chute and said opening are sized to achieve air flow into the transport chute sufficient to produce a net air drag force in the transport direction from the inlet to the outlet to transport the sheet through said transport chute by said air flow; and a discharge outlet defined in the transport chute, the discharge outlet being a slot extending across the transport chute transverse to the transport direction and the slot being arranged between the inlet and the outlet of the transport chute.

15. The sheet transport system of claim 14, wherein said discharge outlet slot extends substantially across the entire width of the transport chute.

16. The sheet transport system of claim 15, wherein:

the transport chute has a height through which the sheet is transported; and said discharge outlet slot has a width that is approximately equal to the height of the transport chute.

17. The sheet transport system of claim 15, wherein:

said inlet is a slot extending substantially the across the entire width of the transport chute transverse to the transport direction; and said inlet slot defines an airflow area that is approximately one-half the airflow area defined by said discharge outlet slot.

* * * * *